US005924781A

United States Patent [19]

Mitchell

[11] Patent Number: 5,924,781

[45] Date of Patent: Jul. 20, 1999

[54] WALL MOUNTED STORAGE CABINET

[75] Inventor: Terry L. Mitchell, Grand Rapids, Mich.

[73] Assignee: Raspberry Med, Inc., Grand Rapids, Mich.

[21] Appl. No.: 08/870,759

[22] Filed: Jun. 9, 1997

[51] Int. Cl.[6] ..... A47B 63/04

[52] U.S. Cl. ..... 312/245; 312/315; 312/319.2; 312/230

[58] Field of Search ..... 312/245, 315, 312/309, 276, 319.2, 310; 108/38

[56] References Cited

U.S. PATENT DOCUMENTS

| | | | |
|---|---|---|---|
| Re. 7,189 | 6/1850 | Cogswell . | |
| 132,632 | 6/1872 | Cogswell | 312/245 X |
| D. 139,753 | 5/1873 | Adams . | |
| 148,776 | 3/1874 | Stewart . | |
| 152,661 | 6/1874 | Mancini | 312/245 X |
| D. 174,785 | 5/1876 | Tompkins . | |
| D. 188,544 | 8/1877 | Carothers . | |
| D. 188,944 | 10/1877 | Blumenthal . | |
| 194,971 | 9/1877 | Morgan | 312/245 |
| D. 244,072 | 4/1881 | Schaecher . | |
| 287,068 | 10/1883 | Tyler | 312/319.2 X |
| D. 287,800 | 1/1883 | Lance . | |
| 357,533 | 2/1887 | Miller . | |
| 509,101 | 11/1893 | Richardson . | |
| 723,964 | 3/1903 | Wilson | 312/245 X |
| 837,000 | 11/1906 | Sibley . | |
| 968,920 | 8/1910 | Campbell . | |
| 1,077,515 | 11/1913 | Fanning . | |
| 1,160,538 | 11/1915 | Silvius | 312/319.2 X |
| 1,192,563 | 7/1916 | Rodrigues . | |
| 1,262,789 | 4/1918 | Heller . | |

(List continued on next page.)

FOREIGN PATENT DOCUMENTS

| | | | |
|---|---|---|---|
| 218397 | 7/1924 | United Kingdom . | |
| 945118 | 4/1964 | United Kingdom | 312/315 |

OTHER PUBLICATIONS

Raspberry Medical, Inc. Exhibit A is a photocopy of a wall mounted storage cabinet (Model #1028CS) on sale for more than one year prior to the filing date of the present application. The cabinet includes a pivotable front cover and an immobile binder receptacle.

Raspberry Medical, Inc. Exhibit B is a photocopy of the cabinet of Exhibit A shown with the front cover pivoted to a vertical position.

Raspberry Medical, Inc. Exhibit C is a photocopy of a wall mounted receptacle (Model #1028–XRCS) on sale for more than one year prior to the filing date of the present application.

Raspberry Medical, Inc. Exhibit D is a photocopy of a wall mounted storage cabinet (Model #1017CS) on sale for more than one year prior to the filing date of the present application. The cabinet includes a pivotable front cover and an immobile binder receptacle.

Raspberry Medical, Inc. Exhibit E is a photocopy a wall mounted storage cabinet (Model #1020EX) on sale for more than one year prior to the filing date of the present application. The cabinet includes a pivotable front cover and an immobile binder receptacle.

(List continued on next page.)

*Primary Examiner*—Peter M. Cuomo
*Assistant Examiner*—David E. Allred
*Attorney, Agent, or Firm*—Van Dyke, Gardner, Linn & Burkhart, LLP

[57] ABSTRACT

A wall mounted storage cabinet includes a compartment having a front cover which is pivotable between a substantially horizontal open position and a substantially vertical closed position. The front cover is spring biased toward the closed position. An inner storage bin or binder holder is pivotally mounted inside of the compartment. The inner storage bin is pivotable between an upright position and an angled forward position. The inner storage bin is constructed to remain in either the forward or upright position, whichever is its current position.

7 Claims, 5 Drawing Sheets

U.S. PATENT DOCUMENTS

| | | | |
|---|---|---|---|
| 1,272,645 | 7/1918 | Fanning . | |
| 1,418,919 | 6/1922 | Hall . | |
| 1,453,943 | 5/1923 | Mitchell . | |
| 1,663,862 | 3/1928 | Rietveld | 312/319.2 X |
| 1,795,698 | 12/1926 | Auerbach . | |
| 1,803,218 | 2/1931 | Sunde . | |
| 2,046,244 | 6/1936 | Carner | 312/309 |
| 2,267,891 | 10/1941 | Baker . | |
| 2,275,373 | 1/1942 | Barrett . | |
| 2,646,188 | 11/1953 | Buescher . | |
| 2,656,563 | 7/1953 | Jones . | |
| 2,686,340 | 7/1954 | Shepard et al. . | |
| 2,758,454 | 5/1956 | Cossin . | |
| 2,897,030 | 7/1959 | Ficarella . | |
| 2,948,015 | 10/1960 | Hansen . | |
| 3,193,341 | 7/1965 | Preston . | |
| 3,333,912 | 8/1967 | Kunz et al. . | |
| 3,353,884 | 11/1967 | Chaffee et al. | 312/245 X |
| 4,366,999 | 1/1983 | Koncelik et al. . | |
| 4,718,740 | 1/1988 | Cox | 312/313 X |
| 4,742,598 | 5/1988 | Bruneau . | |
| 4,843,680 | 7/1989 | Cress et al. . | |
| 4,949,850 | 8/1990 | Weathers . | |
| 5,401,093 | 3/1995 | Resnick . | |
| 5,707,126 | 1/1998 | Neufeld et al. | 312/245 |

OTHER PUBLICATIONS

Raspberry Medical, Inc. Exhibit F is a photocopy a wall mounted storage cabinet (Model #1028CSP–PI) on sale for more than one year prior to the filing date of the present application. The cabinet includes a pivotable front cover and an immobile binder receptacle.

Raspberry Medical, Inc. Exhibit G is a photocopy a wall mounted storage cabinet (Model #1028CSF–MI–MB) on sale for more than one year prior to the filing date of the present application. The cabinet includes a pivotable front cover and an immobile binder receptacle.

Raspberry Medical, Inc. Exhibit H is a photocopy a wall mounted storage cabinet (Model #1017CSF–PI) on sale for more than one year prior to the filing date of the present application. The cabinet includes a pivotable front cover and an immobile binder receptacle.

WALL MOUNTED STORAGE CABINET

BACKGROUND OF THE INVENTION

The present invention relates to wall mounted storage cabinets, and in particular to wall mounted storage cabinets especially suited for hospital and health care environments.

In general, wall mounted storage cabinets typically include a compartment defined by a pair of side walls, a top and bottom wall, and a front and rear wall. The front wall is often pivotable, or otherwise moveable, in order to allow access to the compartment. When neither ingress or egress of items to or from the storage cabinet is desired, the storage cabinet is covered by the pivotable front panel, and the interior of the cabinet is not visible. Often the front panel is downwardly pivotable to a generally horizontal position which allows the front panel to be used as a writing surface. The storage cabinet is desirably compact, aesthetically pleasing, easy to use, and space efficient.

In a hospital or health care environment, additional design criteria must be considered. For example, in a hospital environment, storage cabinets are often used to store prescription medicines or confidential medical information, and the cabinet therefore desirably includes a lock. Hospital storage cabinets are also desirably designed to accommodate the hospital's typical storage needs for a patient or patients and their needs, to be easily adjusted according to the continually changing identity of the patients, to facilitate communication between staff personnel, and of course to be economical.

While prior hospital storage cabinets have addressed these considerations, they have not been without the need for additional improvements. One area of improvement relates to the ease of access to storage bins or other storage sections within the cabinet. Some prior cabinets have included bins, or the like, within the storage cabinet for holding binders and other items. These bins, however, have been rigidly constructed so that removal of items from the bin requires significant empty space within the cabinet which is thereby wasted. An example of one such prior art cabinet can be seen in FIG. 10. FIG. 10 illustrates a prior art wall mounted storage cabinet 1000 which includes a rigid binder storage bin 1002 oriented vertically within storage cabinet 1000. As can be seen, in order to remove a binder 1004 from binder bin 1002, binder 1004 must be lifted vertically upward a distance substantially equal to its height before it can be pulled forward. Removing binder 1004 from bin 1002 therefore requires a significant amount of unobstructed space 1006 which cannot be used for storage purposes. This use of storage space is inefficient, and requires that extra materials and expense be expended in the construction of this type of cabinet. There is also limited ability for facile use of items such as a laptop computer or notebook tie-in with the cabinet, or other communication devices. Thus, prior art hospital storage cabinets lack modularity. They are not capable of a degree of functional interchangeability to accommodate different storage/ease of access requirements.

Another design area of prior hospital storage cabinets for which improvement is desirable relates to the placement of the lock in the storage cabinet. In prior lockable storage cabinets which include a downwardly pivotable front cover that forms a writing surface, the locking mechanism has typically been placed on the front cover itself. The locking mechanism projects outwardly from the back of the front panel and interferes with the use of the back of the front panel as a writing or working surface. This is desirably eliminated.

Other areas of potential improvement for prior cabinet designs include the reduction of costs while maintaining the same quality, the difficulty of storing modem devices, such as computers, in the cabinets, and the obstruction created in a room or hallway by the front panel when it is left in the downwardly pivoted position. It can therefore be seen that a need exists for an improved wall mounted storage cabinet which overcomes these and other disadvantages.

SUMMARY OF THE INVENTION

According to one aspect of the present invention, a cabinet adapted to be mounted to a wall includes a compartment having a front panel pivotally mounted to it. The front panel is pivotable between a closed and an open position and thereby selectively allows access to the compartment. An inner bin is located inside the compartment and is pivotally mounted to allow the bin to pivot between a vertical position and a forward position projecting outwardly from the compartment. The front panel is biased towards the closed position, and the inner bin is biased to remain in its current position.

The wall mounted storage cabinet according to this aspect of the invention thereby provides storage space which is efficiently utilized and is easily accessible. The forward pivotability of the inner bin not only allows a user easier access to the bin, but the cabinet does not require large volumes of unobstructed space. The same amount of storage space can therefore be provided in a more compact cabinet, and the cost of producing the cabinet is consequently reduced. The biasing of the front panel towards a closed position also facilitates the ease of use of the cabinets and ensures that, without human intervention, the hospital hallway is not inadvertently obstructed by outwardly projecting front panels that have been forgotten to be closed. The biasing of the inner bin to remain in its current position facilitates the ease of use of the cabinet. In other aspects of the invention, the cabinet may be mounted in recessed fashion to the wall so that the front panel is securely flush with the wall. Also, the bin is modular in principle so that different adaptions can be selected between file storage to other uses such as reduced file storage and mounting of a lap top for easy access and use.

These and other benefits, results, and objects of the present invention will be apparent to one skilled in the art, in light of the following specification when read in conjunction with the accompanying drawings.

DETAILED DESCRIPTION OF THE PREFERRED EMBODIMENTS

Figure 1:
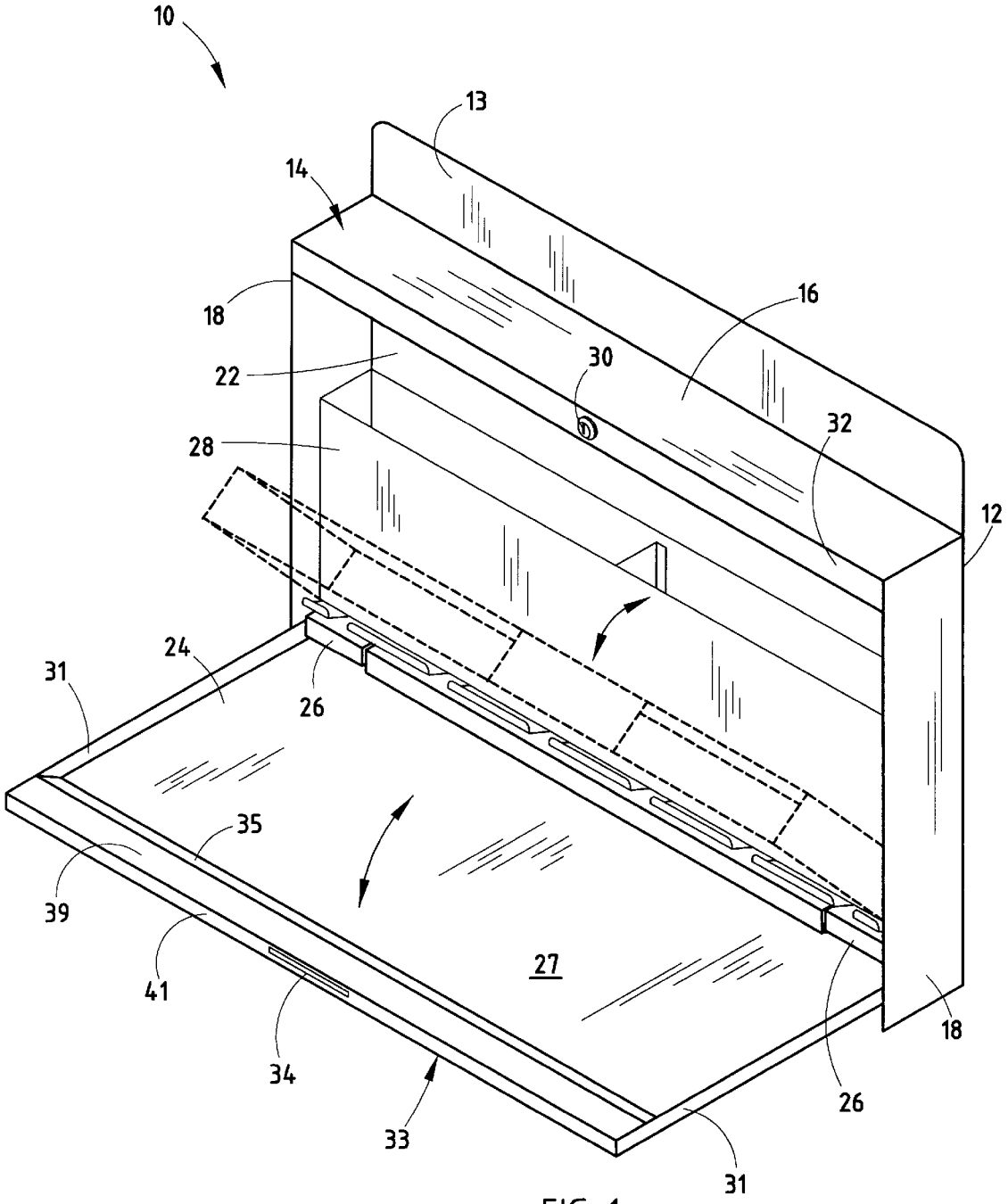
FIG. 1 is a perspective view of a wall mounted storage cabinet according to a first embodiment of the present invention.

The present invention will now be described with reference to the accompanying drawings wherein like reference numerals correspond to like elements in the several drawings. For purposes of description herein, the terms "forward" or "front" and "rearward" or "back" will be used to describe the direction facing the wall and the direction pointing away from the wall, respectively.

Figure 3:
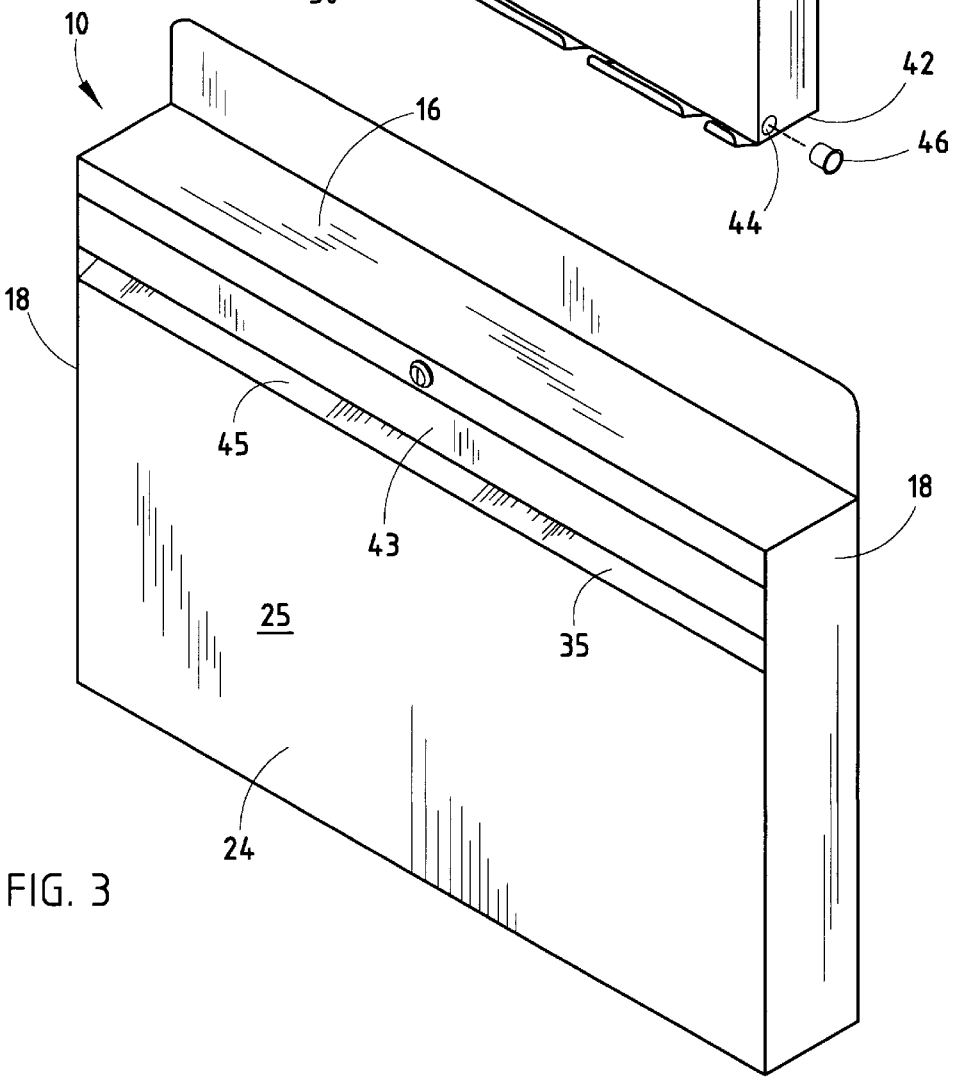
FIG. 3 is a perspective view of the storage cabinet of FIG. 1 illustrated in a closed position.

A wall mounted storage cabinet 10 according to one embodiment of the present invention includes a rear panel 12 secured to a frame 14 (FIG. 1). Frame 14 includes a generally flat top panel 16, and a pair of parallel, downwardly depending side panels 18 oriented roughly at right angles to top panel 16. Top panel 16, and side panels 18 are secured to each other and are oriented to form a generally upside-down U-shaped arrangement for frame 14. Frame 14, in combination with rear panel 12, defines an interior compartment 22. A front panel 24 having a front surface 25 and a back surface 27 is pivotally secured in front of compartment 22 by a pair of spring pivot assemblies 26 located inside compartment 22 near the bottom of side panels 18. Front panel 24 is pivotable between an upright or closed position substantially parallel to rear panel 12 (FIG. 3), and a flat position projecting forwardly from compartment 22 (FIG. 1). Storage cabinet 10 further includes an inner bin 28 pivotally mounted inside of interior compartment 22. Inner bin 28 is pivotable between an upright position and a forward position (shown in phantom, FIG. 1) independently of front panel 24.

In the illustrated embodiment, rear panel 12 includes an upper flange 13 which extends above top panel 16. With upper flange 13 extending above top panel 16, cabinet 10 is designed to be mounted to a wall such that rear panel 12 abuts against the wall and cabinet 10 projects forwardly from the wall. Cabinet 10 can alternatively be configured such that rear panel 12 extends no higher than the top of top panel 16. In this configuration, cabinet 10 is designed to be mounted in a recess formed in the wall such that the front of cabinet 10 is substantially flush with the wall. When designed to be flush mounted, cabinet 10 may optionally include an upper front flange such as can be seen in the embodiment depicted in FIG. 8.

Figure 2:
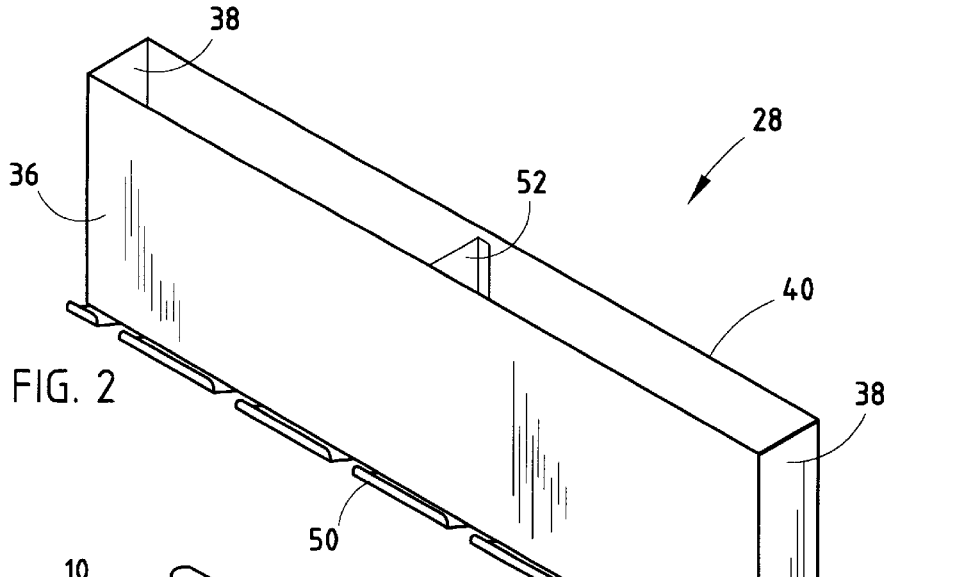
FIG. 2 is a perspective view of an inner bin of the cabinet shown in FIG. 1.
Figure 4:
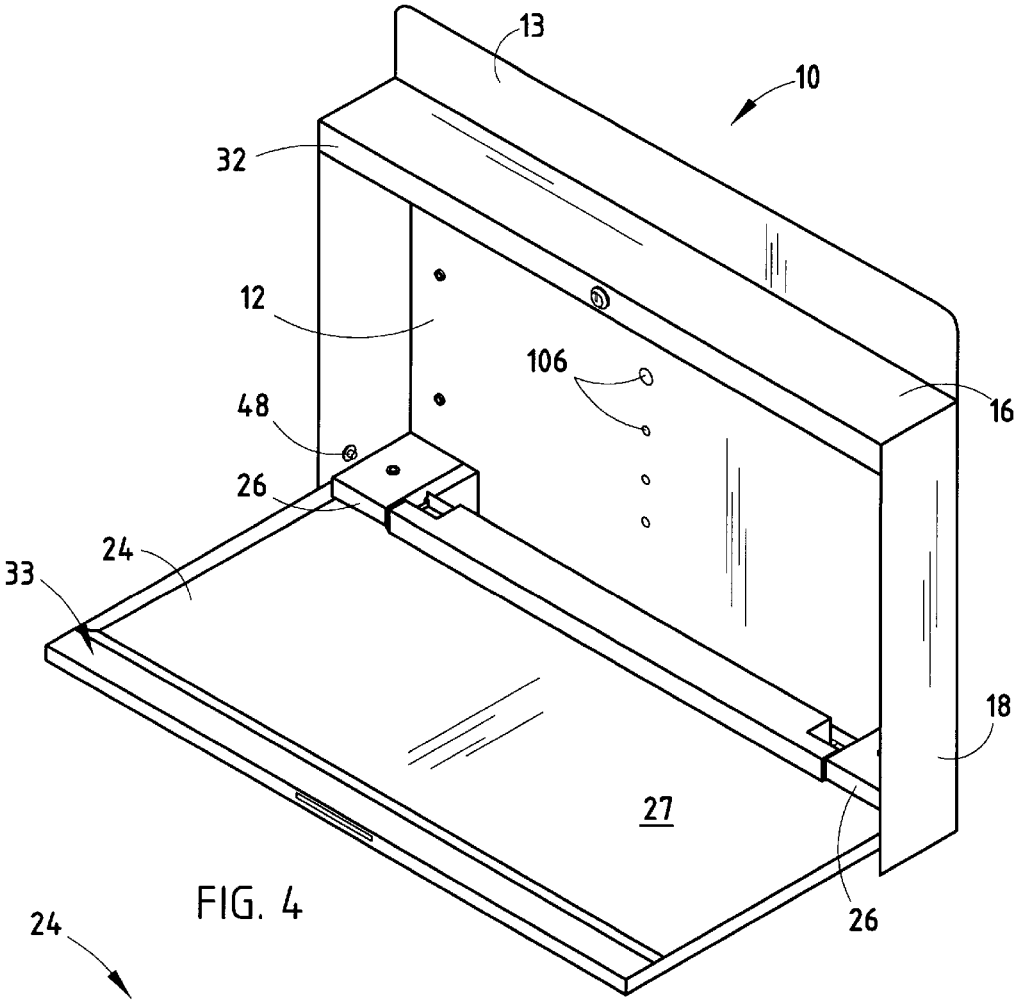
FIG. 4 is a perspective view of the cabinet of FIG. 1 illustrated with the inner bin removed.

Inner bin or item holder 28 is a modular part which can be used with a variety of differently designed storage cabinets. Inner bin or item holder 28 includes, at the very least, a front wall 36. Inner bin 28 may also include a bottom 42 secured to front wall 36 at generally a right angle to form a mounting plate 102 for a computer as described below (See FIG. 8). When cabinet 10 includes mounting plate 102, compartment 22 will define an aperture for receiving electrical power, such as that illustrated in FIG. 8 (aperture 96). In the preferred embodiment, inner bin 28 also includes a pair of side walls 38 extending back from front wall 36 and a rear wall 40 generally parallel to front wall 36 (FIG. 2). The walls and bottom are secured to each other to form an item holding receptacle having an open top to allow ingress and egress of items thereto. Front wall 36 includes a front surface 37 which may preferably be covered with a porcelainized coating that enables a dry erase marker to be written and erased on it. Side walls 38 of bin 28 each include a circular aperture 44 defined in the lower, forward comer of side walls 38. Circular apertures 44 are aligned with each other and define the pivot axis of inner bin 28. A bushing 46 is inserted into each circular aperture 44 in side walls 38. A pair of pivot pins 48 are welded onto side panels 18 of compartment 22 and extend inwardly toward each other (FIG. 4). Bushings 46 matingly receive pivot pins 48 and thereby allow inner bin 28 to pivot about pivot pins 48. The locations of circular apertures 44 in side walls 38 ensures that bin 28 will be biased or weighted to remain in either the forward or upright position once moved there.

Inner bin 28 further includes a segmented bin stop 50 projecting angularly upward from bottom 42 of bin 28 (FIG. 2). Segmented bin stop 50 is an extension of bottom 42 and prevents bin 28 from being pivoted forward past an angle of approximately 45 °. Segmented bin stop 50 also serves as a pen or pencil holder and the segmentation facilitates grasping the pens or pencils. It will be understood that the angle of segmented bins stops 50 can be varied to allow for different degrees of forward movement of inner bin 28. Bin 28 may also include a divider wall 52 secured approximately midway between side walls 38 and extending from rear wall 40 to front wall 46. Divider wall 52 thereby divides inner bin 28 into two separate receptacles.

A lock 30 is secured in an overhang flange 32 which is adjacent and generally perpendicular to top panel 16 (FIG. 1). Lock 30 is adapted to rotate upon insertion of a key between a locked and an unlocked position. Lock 30 includes a locking tab (not shown) which, in the unlocked position, is hidden behind overhang flange 32. When lock 30 is in the locking position, the locking tab is rotated downward and inserts into a lock slot 34 on front panel 24 (FIGS. 4 and 5) when front panel 24 is in the closed, upright position. The insertion of the locking tab into lock slot 34 thereby prevents front panel 24 from being pivoted. The placement of lock 30 in overhang flange 32 allows back surface 27 to be generally flat and overcomes the prior disadvantage of having a lock projecting out of the back surface 27 of front panel 24 which interferes with the use of front panel 24 as a writing surface.

Figure 5:
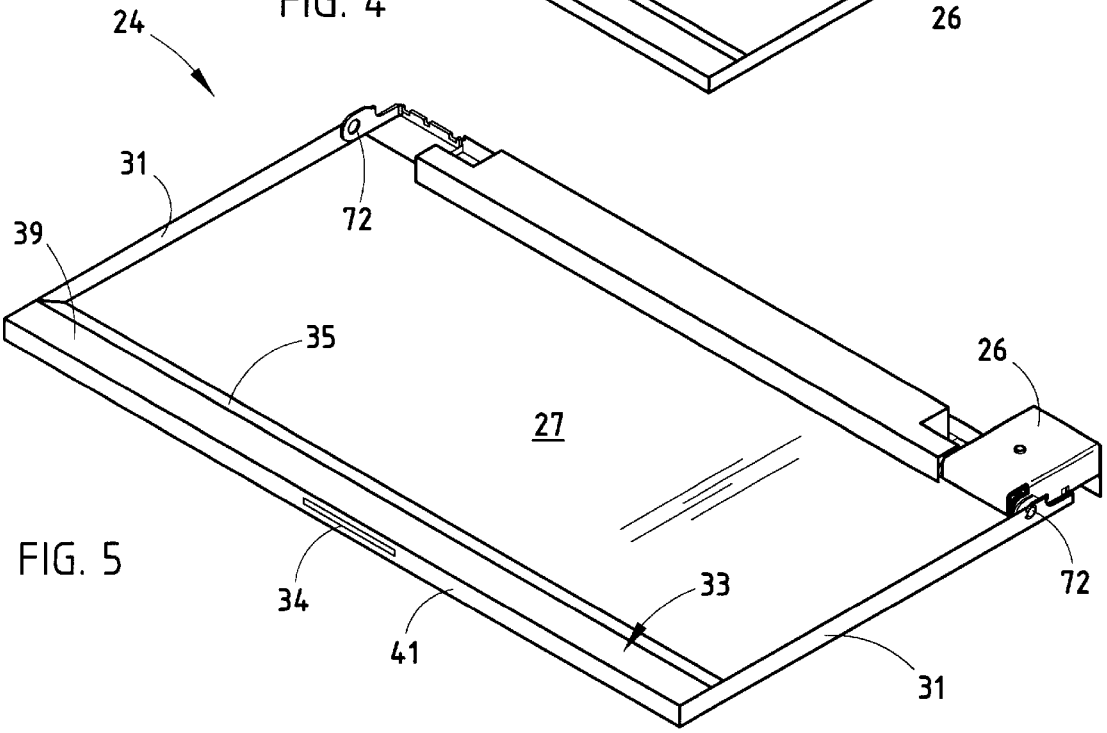
FIG. 5 is a perspective view of a front panel of the cabinet of FIG. 1 shown with a spring assembly removed.

Front panel 24 includes a pair of side flanges 31 which extend along the sides of front panel 24 at generally a right angle (FIGS. 4 and 5). Side flanges 31 help prevent pens, pencils and the like from falling off of front panel 24 when it is in a flat position. Front panel 24 further includes a handle 33 adjacent the top or the front of front panel 24, depending upon the current position to which front panel 24 is pivoted. Handle 33 is defined by an angled surface 35, a flat, recessed surface 39, a top surface 41, and a gripping surface 43 (FIG. 3) generally parallel to recessed surface 39. Angled surface 35, recessed surface 39, top surface 41, and gripping surface 43 are configured to define a recess 45 into which a user's fingers can be inserted. Front panel 24 is opened by grabbing the back side of gripping surface 43 and pulling forward. Handle 33 also helps prevent pens, pencils, and the like from falling off of the front end of front panel 24 when it is in the open, horizontal position.

Figure 7:
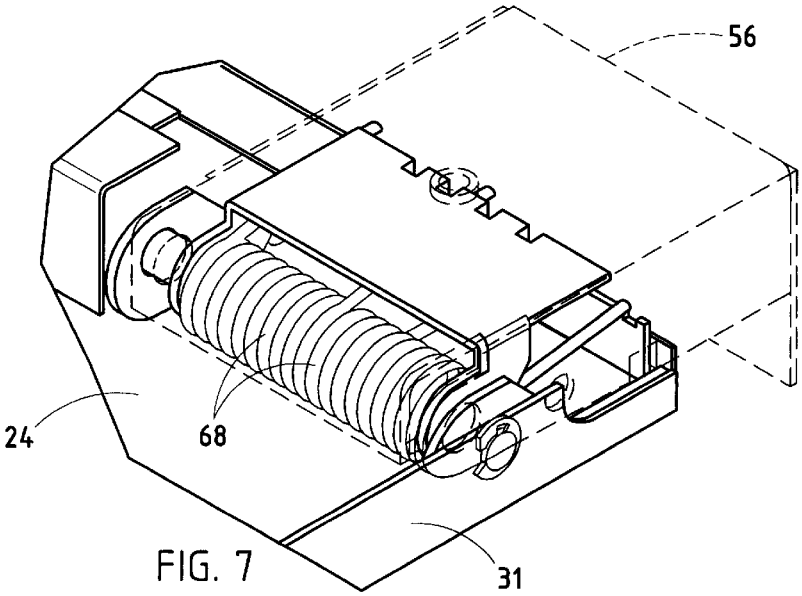
FIG. 7 is a perspective view of the spring assembly of FIG. 6 shown in an assembled form.
Figure 6:
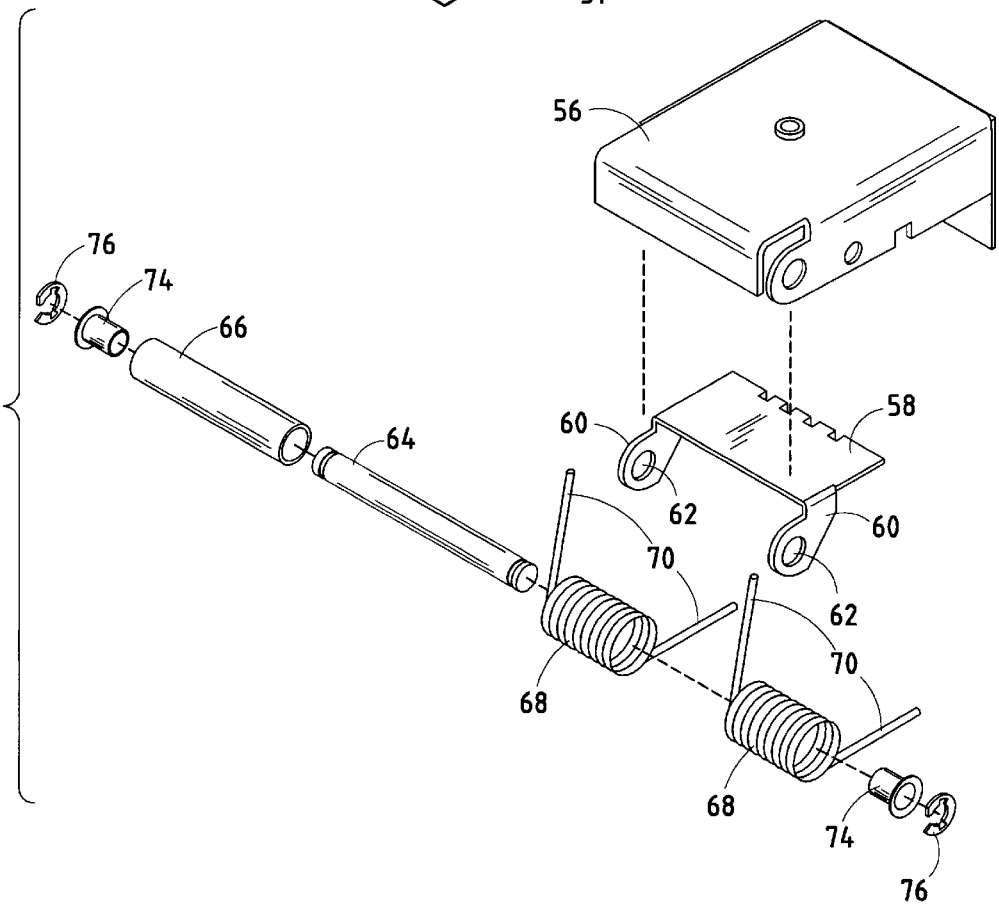
FIG. 6 is an exploded, perspective view of a spring assembly used in one embodiment of the present invention.
Figure 10:
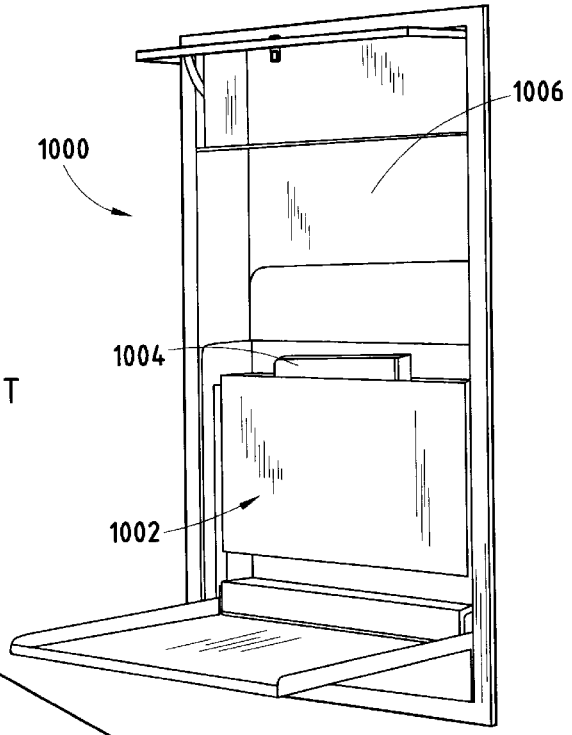
FIG. 10 PRIOR ART
Figure 9:
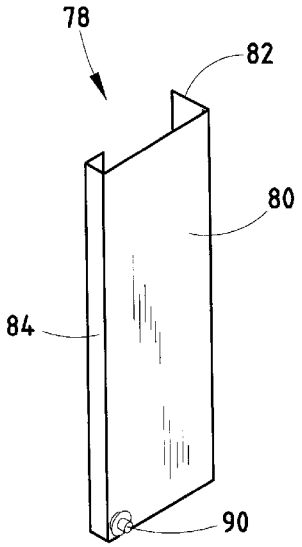
FIG. 9 is a perspective view of a middle panel of the cabinet of FIG. 8; and, FIG. 10 is a perspective view of a prior art wall mounted storage cabinet.

Spring pivot assemblies 26, which bias front panel 24 toward an upright position, each include a rotation bracket 56 and a spring adjustment bracket 58 which is dimensioned to fit under rotation bracket 56 (FIGS. 6 and 7). Spring adjustment bracket 58 includes a pair of arms 60 which define a pair of aligned apertures 62 through which a pivot rod 64 is inserted. Surrounding pivot rod 64 is a cylindrical spacer 66 and a pair of springs 68. Pivot rod 64 extends through a pair of aligned apertures 72 on front panel 24 (See FIG. 4) and thereby secures front panel 24 to spring pivot assemblies 26. A bushing 74 and a retaining ring 76 are inserted into spacer 66 over pivot rod 64 and prevent pivot rod 64 from sliding out of aligned aperture 72 on front panel 24. Springs 68 each include a pair of legs 70 which are oriented generally at right angles to each other when viewed axially. One leg engages spring adjustment bracket 58 and the other leg engages the bottom of front panel 24. In this manner, when front panel 24 is pivoted forward, the angle between legs 70 of spring 68 is resiliently decreased and spring 68 thereby exerts a biasing force against front panel 24. The biasing force acts against the bottom of front panel 24 and biases front panel 24 toward a closed position.

In the preferred embodiment, side panels 18, top panel 16, and bottom panel 20 are all constructed from steel. Front panel or door 24 is preferably constructed from aluminum. Of course it will be understood that a variety of different materials are suitable as would be known by one skilled in the art.

Figure 8:
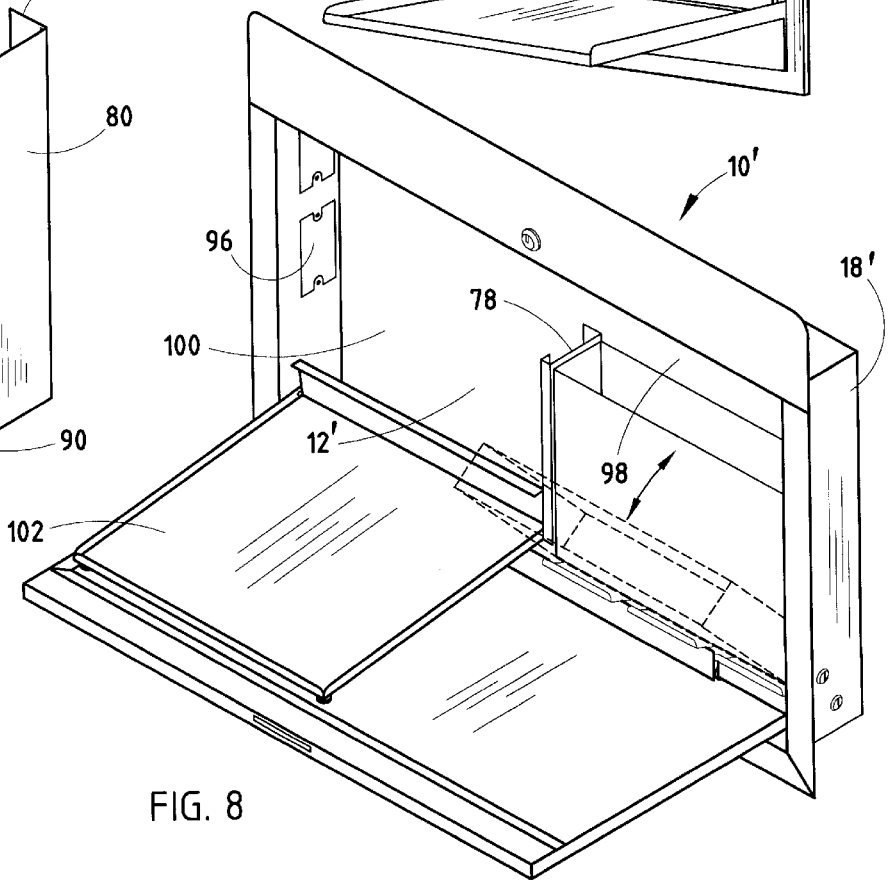
FIG. 8 is a perspective view of a wall mounted storage cabinet according to a second embodiment of the present invention.

FIG. 8 illustrates a wall mounted storage cabinet 10' according to a second embodiment of the present invention. Like elements are denoted by the same number followed by a prime symbol. Storage cabinet 10' includes a center panel 78 attached to rear panel 12' approximately midway between, and generally parallel to, side panels 18'. Center panel 78 divides storage cabinet 10' into a right compartment 98 and a left compartment 100. In the illustrated embodiment, right compartment 98 contains an independently pivotable inner bin 28', and left compartment 100 contains an independently pivotable mounting plate 102. Mounting plate 102 is adapted to allow a laptop computer, or the like, to be mounted onto it.

Center panel 78 generally includes a main panel 80 having a rear flange 82 and an "L" shaped front flange 84. Rear flange 82 is oriented generally at a right angle to main panel 80 and includes one or more apertures (not shown) through which screws or the like are inserted to secure center panel 78 to rear panel 12'. A first pivot access aperture (not shown) is defined adjacent the bottom, front comer of center panel 78 and receives a pivot pin 90 which is inserted through circular aperture 44' in inner bin 28'. Inner bin 28' is thus rotatable about the axis of pivot pin 90. A second pivot access aperture is defined in front flange 84 (not shown) in axial alignment with the first pivot axis aperture. A second pivot pin is similarly inserted through the second pivot access aperture and into an aligned aperture in mounting plate 102. Mounting plate 102 is thus pivotable about an axis defined by the second pivot pin, which is collinear with the pivot access of inner bin 28'. Inner bin 28' and mounting plate 102 are independently pivotable with respect to each other and with respect to front panel 24'. The location of circular apertures 44' in inner bin 28' ensure that inner bin 28' will remain in its current forward or upright position via gravity. The location of apertures 104 in mounting plate 102 yields a similar effect.

The side panel 18' adjacent mounting plate 102 includes one or more openings 96 for providing access to an electrical outlet for powering a computer or other electrical device mounted to mounting plate 102. A second opening 96 may be provided to allow access to a phone line or other data transmission line for the computer.

It will of course be understood that storage cabinet 10' could alternatively include a pair of side by side inner bins 28' instead of the combination of a single inner bin 28' and a mounting plate 102. Or storage cabinet 10' could alternatively include a pair of mounting plates 102 instead of a single mounting plate and an inner bin. Furthermore, the positioning of inner bin 28' and mounting plate 102 can be selectively switched so that inner bin 28' is located in left compartment 100 of storage cabinet 10' and mounting plate 102 is located in right compartment 98 of storage cabinet 10'.

Center panel 78 can also be affixed to rear panel 12 in the first embodiment. In such a case, center panel 78 is secured to rear panel 10 via fasteners inserted through a set of center apertures 106 in rear panel 12 (See FIG. 4). Due to the modular nature of inner bins 28 and 28', and mounting plate 102, cabinet 10 can be easily converted to a cabinet having both inner bin 28' and mounting plate 102 positioned side-by-side and separated by center panel 78. Such alterations allow cabinet 10 to be converted to generally resemble cabinet 10'.

While the present invention has been described in terms of the preferred embodiments depicted in the drawings and discussed in the above specification, it will be understood by one skilled in the art that the present invention is not limited to these particular preferred embodiments, but includes any and all such modifications that are within the spirit and scope of the present invention as defined in the appended claims.

The embodiments of the invention in which an exclusive property or privilege is claimed are defined as follows:

1. A cabinet adapted to be mounted to a wall, comprising:

a compartment;

a front panel pivotally mounted to said compartment, said front panel pivotable between a closed position wherein said compartment is substantially completely enclosed and an open position wherein said front panel is substantially horizontal, said front panel cantilevered at a pivot of a hinged end of said front panel when in said open position;

said pivot being a spring biased pivot pivotally securing said front panel to said compartment, said spring biased pivot biasing said front panel toward said closed position;

an inner bin including at least a front wall, said inner bin pivotably mounted and supported independently of said front panel inside of said compartment, said inner bin pivotable between a substantially vertical position and a forward position projecting outwardly from said compartment, said inner bin pivotable independently of the movement of said front panel from its closed position to its open position, said inner bin biased to remain in said substantially vertical position when said inner bin is in said substantially vertical position and to remain in said forward position when said inner bin is in said forward position; and wherein said inner bin further includes a forwardly extending stop that limits rotation of said inner bin a predetermined amount less then 90° by contacting said front panel.

2. The cabinet of claim 1 wherein said inner bin further includes side walls, secured to said front wall, a rear wall secured to said side walls, and a bottom secured to said side, front, and rear walls.

3. The cabinet of claim 1 wherein said compartment further includes a lock disposed in said cabinet above said compartment and adjacent said front panel when said front panel is in said closed position, said lock selectively prohibiting the pivoting of said front panel and thereby selectively prohibiting access to said compartment.

4. The cabinet of claim 1 wherein a flange extends from a front edge of said compartment for abutment with said wall such that said front panel is substantially flush with the wall when said cabinet is mounted in said wall.

5. The cabinet of claim 1 wherein said front wall of said bin is coated to allow writing and erasing of dry marker on said front wall.

6. The cabinet of claim 1 wherein said inner bin is adapted to allow a computer to be mounted to said inner bin.

7. The cabinet of claim 6 wherein said compartment defines an aperture through which electrical power can be accessed.

* * * * *

UNITED STATES PATENT AND TRADEMARK OFFICE

CERTIFICATE OF CORRECTION

PATENT NO. : 5,924,781
DATED : July 20, 1999
INVENTOR(S) : Terry L. Mitchell

It is certified that error appears in the above-identified patent and that said Letters Patent is hereby corrected as shown below:

Column 2,
Line 3, “modem” should be -- modern --

Column 4,
Line 1, “comer” should be -- corner --

Column 5,
Line 38, “comer” should be -- corner --

Signed and Sealed this

Thirty-first Day of December, 2002

JAMES E. ROGAN
*Director of the United States Patent and Trademark Office*